US006834850B2

(12) United States Patent
Fukuchi

(10) Patent No.: US 6,834,850 B2
(45) Date of Patent: Dec. 28, 2004

(54) PERCUSSIVE NOISES SUPRESSING SHEET FEEDING METHOD AND APPARATUS

(75) Inventor: Yutaka Fukuchi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 10/279,904

(22) Filed: Oct. 25, 2002

(65) Prior Publication Data

US 2003/0085508 A1 May 8, 2003

(30) Foreign Application Priority Data

Oct. 26, 2001 (JP) ..... P2001-329476

(51) Int. Cl.[7] ..... B05H 5/06

(52) U.S. Cl. ..... 271/10.11; 271/114; 271/10.01; 271/10.09

(58) Field of Search ..... 271/10.09, 114, 271/121, 10.13, 10.1, 10.11, 10.01

(56) References Cited

U.S. PATENT DOCUMENTS

| | | | | |
|---|---|---|---|---|
| 5,040,025 A | | 8/1991 | Fukuchi | |
| 5,052,336 A | | 10/1991 | Fukuchi | |
| 5,055,881 A | | 10/1991 | Fukuchi | |
| 5,124,759 A | | 6/1992 | Fukuchi et al. | |
| 5,293,204 A | * | 3/1994 | Tabuchi | 399/394 |
| 5,300,996 A | | 4/1994 | Yokoyama et al. | |
| 5,329,340 A | | 7/1994 | Fukuchi et al. | |
| 5,374,047 A | * | 12/1994 | Tsukamoto et al. | 271/10.01 |
| 5,689,764 A | | 11/1997 | Fukuchi et al. | |
| RE36,124 E | | 3/1999 | Yokoyama et al. | |
| 6,128,451 A | | 10/2000 | Fukuchi | |
| 6,181,899 B1 | | 1/2001 | Fukuchi | |
| 6,332,608 B1 | * | 12/2001 | Tamura | 271/111 |
| 6,385,418 B1 | | 5/2002 | Fukuchi | |

FOREIGN PATENT DOCUMENTS

JP 5-330697 12/1993

OTHER PUBLICATIONS

U.S. patent application Ser. No. 10/279,904, Fukuchi, filed Oct. 25, 2002.
U.S. patent application Ser. No. 10/417,169, Fukuchi, filed Apr. 17, 2003.
U.S. patent application Ser. No. 10/660,571, Noguchi et al., filed Sep. 12, 2003.
U.S. patent application Ser. No. 10/695,794, Kuma et al., filed Oct. 30, 2003.
U.S. patent application Ser. No. 09/725,063, Nov. 29, 2000, pending.
U.S. patent application Ser. No. 09/982,878, Oct. 22, 2001, pending.

* cited by examiner

*Primary Examiner*—Donald P. Walsh
*Assistant Examiner*—Kaitlin Joerger
(74) *Attorney, Agent, or Firm*—Oblon, Spivak, McClelland, Maier & Neustadt, P.C.

(57) ABSTRACT

To suppress vibration and percussive noises generally created by a separation pad and pressure spring in a sheet feeding apparatus, a sheet feeding tray stacks and maintains sheets, a sheet feeding roller launches sheets stacked on the sheet feeding tray, and a separation pad separates sheets from each other. In particular, when feeding a last sheet of one job, the sheet feeding roller stops rotating while pinching an uppermost sheet of a next job in cooperation with the separation pad.

16 Claims, 10 Drawing Sheets

PERCUSSIVE NOISES SUPRESSING SHEET FEEDING METHOD AND APPARATUS

CROSS REFERENCE TO RELATED APPLICATION

This application claims priority under 35 USC §119 to Japanese Patent Application No. 2001-329476 filed on Oct. 26, 2001, the entire contents of which are hereby incorporated herein by reference.

BACKGROUND OF THE INVENTION

1. Field of the Invention

This invention relates to a sheet feeding method and apparatus capable of supplying sheets, serving as recording mediums, either to an image forming device, arranged in a copier, a printer, a facsimile, a complex machine combining these functions, or the like, or a printing device arranged in a printer.

2. Discussion of the Background

In an image forming apparatus typified by a copier or printer, an image is generally formed on a recording medium, such as a sheet, an OHP sheet, etc. (hereinafter simply referred to as a sheet), in accordance with read or input image information. When the image is formed, sheets should be fed toward an image forming section one by one. The plural sheets are generally stacked on a sheet feeding tray or cassette, and are separated and withdrawn from the upper most sheet one by one, thereby being launched from the stack toward the image forming section. Such a mechanism is generally referred to as a "sheet separating mechanism" as illustrated in FIG. 7 as one example.

FIG. 7 roughly illustrates a background sheet separating mechanism that picks up the upper most sheet S1 from among a sheet bundle stacked on a sheet-feeding tray 1. Also roughly illustrated is a route that conducts a sheet to a transfer position of a photoconductive member 7 from the sheet separating mechanism by a pair of register rollers 4. The sheet separating mechanism is configured from a sheet-feeding roller 2, a separating pad 3, and a pressure spring 3*a* that biases the separating pad 3 toward the sheet-feeding roller 2.

The sheet bundle loaded on the sheet feeding tray 1 is pushed up by an elevation mechanism (not shown) so that the upper most sheet S1 can pressure contact the sheet feeding roller 2 arranged in the sheet exit side of the sheet feeding tray 1. The separation pad 3 is provided biased by the pressure spring 3*a* and is arranged to oppose the sheet feeding roller 2. Thus, the separation pad 3 is elastically biased and pushed toward the sheet-feeding roller 2 by the pressure spring 3*a*.

In such a condition, when the sheet feeding roller 2 is rotated upon reception of a sheet feeding signal from a control section (not shown) of an image forming apparatus, only the uppermost sheet S1 is separated and fed toward the following register roller 4. The register roller 4 of this embodiment is arranged substantially perpendicular to and above the sheet-feeding tray 1. Thus, a sheet S is upwardly fed along a guide plate 5. Then, the tip of a sheet S arrives at a nip of the pair of the register rollers 4, and a sheet S slackens and enters a standby state to synchronize with a tip of a visualized image developed by toner on the photoconductive (PC) member 7. Further, reference numeral 6 represents a transfer roller. Various known apparatuses of charging, writing, charge removing, developing, transferring, separating, and cleaning apparatuses and so on are arranged to execute a conventional electronic photographic process along the outer circumference of the PC member 7.

Thus, both the register roller 4 and sheet-feeding roller 2 recommence to drive in synchronism with the tip of the visualized image. A sheet S is lead to the nip formed between the PC member 7 and the transfer roller 6. After receiving transfer of a toner image, the sheet S is separated from the PC member 7 by a separating apparatus (not shown). The sheet S is then ejected from a sheet ejection section after the visualized image is fixed by a fixing apparatus (not shown).

Further, a sheet feeding speed on a path downstream of the sheet feeding roller 2 to a position immediately before the pair of register rollers 4 is set to be faster than that on a path downstream of the register roller pair 4, i.e., from register roller pair 4 to the sheet ejection section by the PC member 7 and the fixing section. That is, the sheet feeding speed is increased until a position immediately before the register roller pair 4 to shorten a first printing time period.

As shown in FIG. 8, in such a sheet separation mechanism, the uppermost sheet S2 of the next job is not fed (i.e., the tip S2h of the sheet S2 stops at an entrance of the separation pad 3) when the register roller 4 and sheet feeding roller 2 resume driving so that a sheet S1 corresponding to the last copy of a job can synchronize with a tip of the above-described visualized image. As a result, when the trailing end S1e of the sheet S1 exits from the nip formed between the sheet feeding roller 2 and separation pad 3, the separation pad 3 is flipped by the trailing end S1e of the sheet S1 and hits the sheet feeding roller 2 or is pulled in a sheet S feeding direction and is flipped by the pressure spring 3*a* and contacts the surfaces of the sheet feeding tray 1 guide and sheet feeding roller 2. As a result, percussive noises are occasionally created. Further, the noise can be amplified by resonance of the pressure spring 3*a*.

SUMMARY OF THE INVENTION

Accordingly, an object of the present invention is to address and resolve the above-noted and other problems and provide a novel sheet feeding apparatus and method that address and resolve the above-noted and other problems.

The above and other objects are achieved according to the present invention by providing a novel sheet feeding apparatus and method including launching sheets stacked on a sheet feeding tray using a sheet feeding roller, separating double feed sheets using a separation pad, and feeding a separated sheet to a prescribed position. Further, the separated sheet is controlled to always intervene between the sheet feeding roller and separation pad when the sheet feeding roller stops rotating.

In another embodiment, a job is completed by stopping feeding of a sheet when a last sheet of the job is completed, and when a headmost sheet of the next job is continuously fed and pinched by the sheet feeding roller and separation pad.

In yet another embodiment, a sheet feeding apparatus includes a sheet feeding tray configured to stack and maintain sheets, a sheet feeding roller operative to launch the sheets stacked on the sheet feeding tray, and a separation pad operative to separate launched sheets when double feed occurs. Further, the sheet feeding roller stops rotating while pinching a headmost sheet of the next job in cooperation with the separation pad after the last sheet of a precedent job is fed.

In yet another embodiment, an inertia-generating device is provided in a sheet feed driving unit to generate inertia force, and the inertia-generating device controls the stoppage of the sheet-feeding roller.

In yet another embodiment, the inertia-generating device includes a flywheel.

In yet another embodiment, the controlling device, which adjusts a timing of canceling power transmission of a power transmitting mechanism, controls the sheet-feeding roller to stop.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
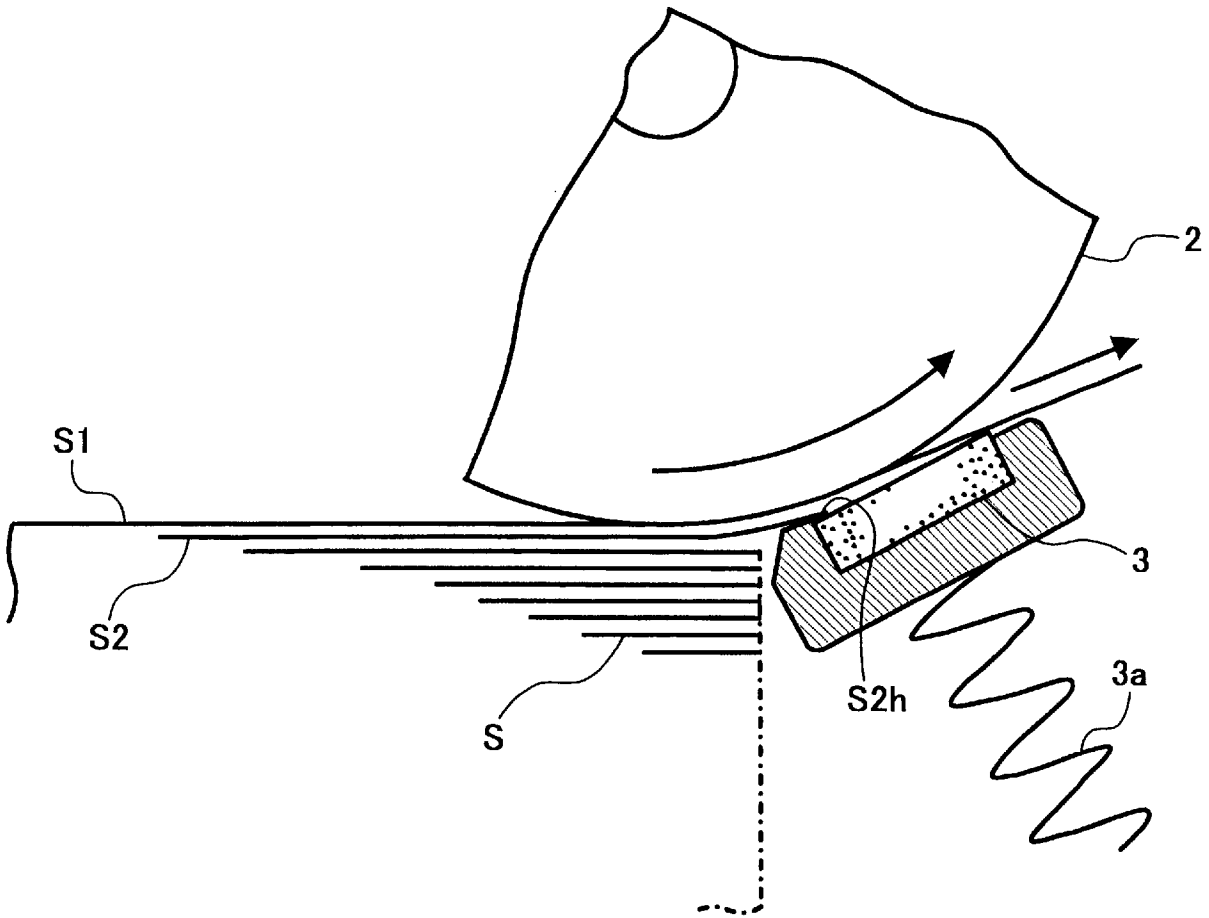
FIG. 1 is a chart illustrating an operation of a sheet feeding apparatus, and in particular a condition when the upper most sheet among sheets stacked on a sheet feeding cassette is launched by a sheet feeding roller, as one embodiment according to the present invention.

Referring now to the drawings, wherein like reference numerals designate identical or corresponding parts throughout the several views, and in particular in FIGS. 1 to 4, an operation of a sheet feeding apparatus is illustrated as one embodiment of the present invention.

In particular, FIG. 1 illustrates a condition when a sheet-feeding roller 2 launches the uppermost sheet S1 among sheets S stacked on a sheet-feeding tray 1. At that time, a separating pad 3 separates a subsequently launched sheet S2 directly below the uppermost sheet S1. The tip S2h of the sheet S2 stops at a position as shown in FIG. 1 due to a friction between itself and the separation pad 3 section. Further, a friction between the sheets S1 and S2 is less in comparison to that between the sheet S2 and the separation pad 3 section. As a result, the sheet S1 is fed sliding on the surface of the sheet S2, and the sheet S2 is not launched any more.

Figure 2:
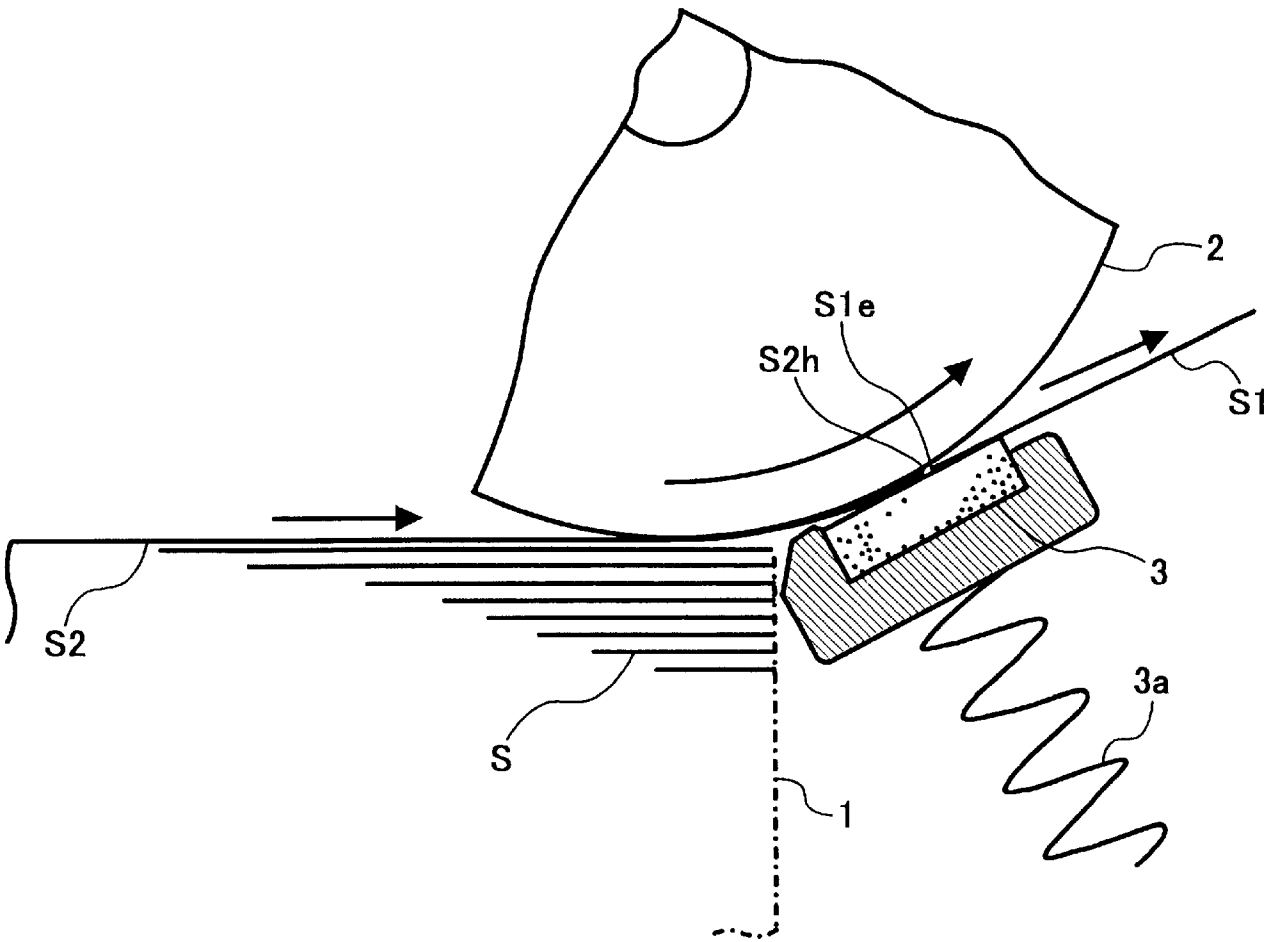
FIG. 2 is a chart illustrating an operation of a sheet feeding apparatus, and in particular a condition when a sheet-feeding roller together with the last sheet of a former job launches a uppermost sheet of a latter job, as one embodiment according to the present invention.

Then, as illustrated in FIG. 2, the sheet-feeding roller 2 contacts the sheet S2 when the trailing end S1e of the sheet S1 no longer contacts the sheet S2. Further, a friction between the sheet feeding roller 2 and sheet S2 is larger in comparison to that between the sheet S2 and separation pad 3 section. As a result, the sheet S2 is launched by the sheet-feeding roller 2.

Figure 3:
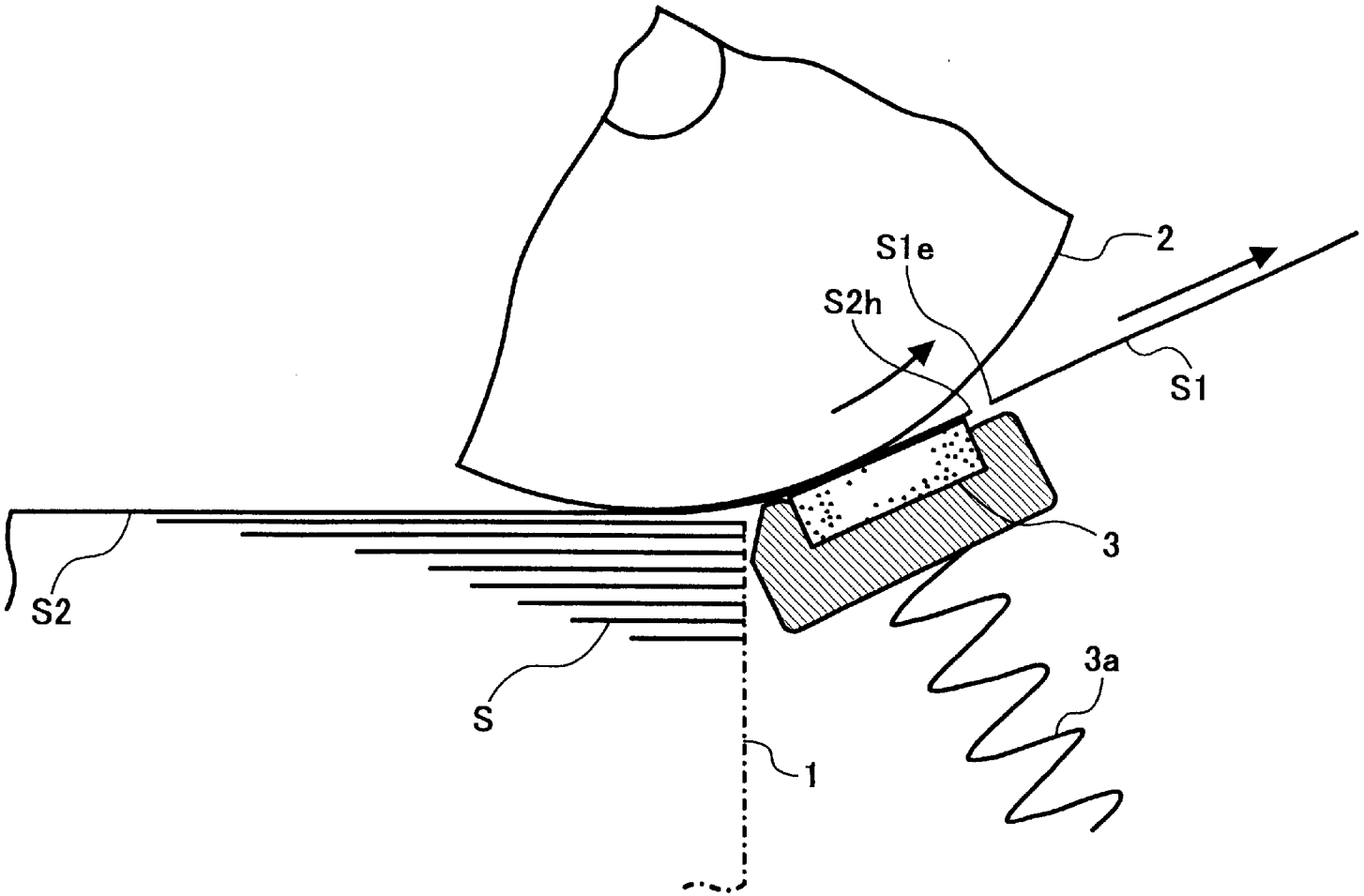
FIG. 3 is a chart illustrating an operation of a sheet feeding apparatus, and in particular a condition when the last sheet of a former job and an uppermost sheet of a latter job are fed substantially without an interval therebetween, as one embodiment according to the present invention.
Figure 4:
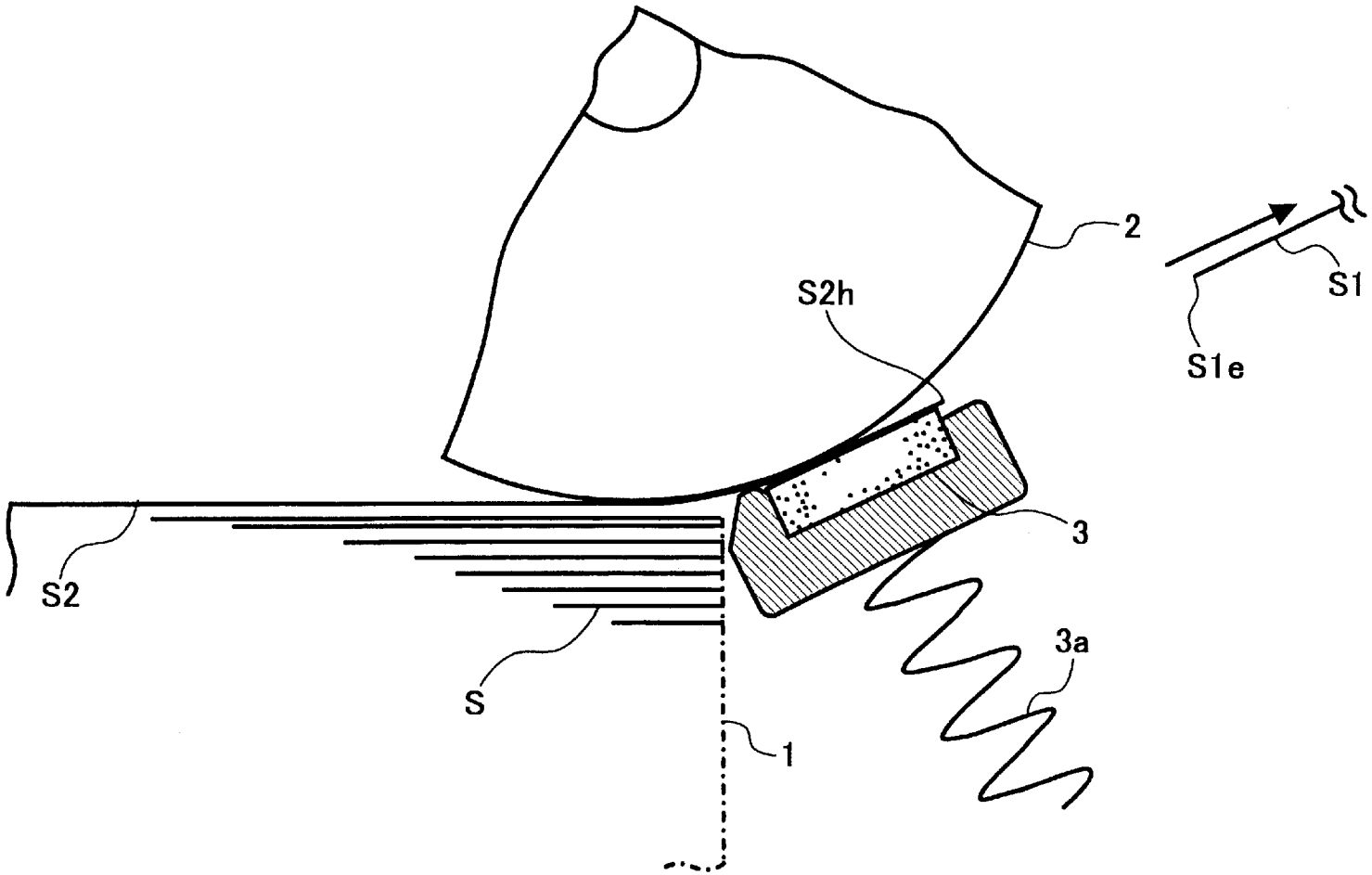
FIG. 4 is a chart illustrating an operation of a sheet feeding apparatus, and in particular a condition when transmission of power from the sheet-feeding roller is cut while a tip of a sheet of a latter job is pinched by the sheet-feeding roller and separation pad, as one embodiment according to the present invention.

In addition, as illustrated in FIG. 3, when the sheet-feeding roller 2 continues rotating, the trailing end S1e of the sheet S1 and the tip of the sheet S2 are successively fed substantially without an interval therebetween. Further, transmission of the power from the sheet feeding roller 2 is cut while the tip of the sheet S2 is pinched by the sheet feeding roller 2 and separation pad 3 as illustrated in FIG. 4. When cutting transmission of power, a later described clutch can be omitted. Otherwise, a motor driving the sheet-feeding roller 2 can be stopped from rotating. Thus, the sheets S can be launched from the sheet-feeding tray 1 as if a continuously long sheet is fed during the time the sheet-feeding roller 2 is driven.

During that time, since one of the sheets S is always positioned between the separation pad 3 and sheet-feeding roller 2, the separation pad 3 almost never contacts the sheet-feeding roller 2. In addition, since the tip S2h of the subsequent sheet S2 intervenes between the separation pad 3 and sheet feeding roller 2 when the trailing end S1e of the sheet S1 leaves the separation pad 3 and the sheet feeding roller 2, the separation pad 3 does not contact the sheet feeding roller 2 and percussive noises are not created. Specifically, even if intervals exist between launched sheets S, these sheets S are continuously fed so that one of the sheets always intervenes between the separation pad 3 and sheet feeding roller 2, before one image forming or copying job is completed. The job represents a series of operations performed, for example, when three sets of copies are made from 10 original documents in a copying operation, or that performed when a printing operation is instructed and completed in a printer.

Further, when only the uppermost sheet S1 is picked up by the sheet feeding roller 2 as illustrated in FIG. 1 while double feed (i.e., an improper feed of two sheets simultaneously) is avoided, the sheet feeding roller 2 contacts and starts feeding the next sheet S2 when the trailing end S1e of the upper most sheet S1 passes through the tip S2h of the next sheet S2.

As a result, both former and subsequent sheets S1 and S2 are successively fed substantially without an interval, and a sheet always intervenes between the separation pad 3 and sheet feeding roller 2, thereby the separation pad 3 almost never contacts the sheet feeding roller 2 also in this case.

However, since the sheet S of the next job is not fed when the above-described job is completed, the probability exists that the above-described separation pad 3 contacts either the sheet-feeding roller 2 or the sheet-feeding tray 1 as a problem after the last sheet of a last job is fed. According to the present embodiment, however, the next sheet S is continuously fed even after the last sheet is fed to a section between the separation pad 3 and sheet feeding roller 2, and waits for commencement of a next job while being pinched therebetween. Thus, if a sheet feeding operation is controlled in this way, a sheet S always intervenes between the separation pad 3 and the sheet feeding roller 2. As a result, percussive noises are not created by contact or collision of the separation pad 3 with the sheet feeding roller 2.

Figure 5:
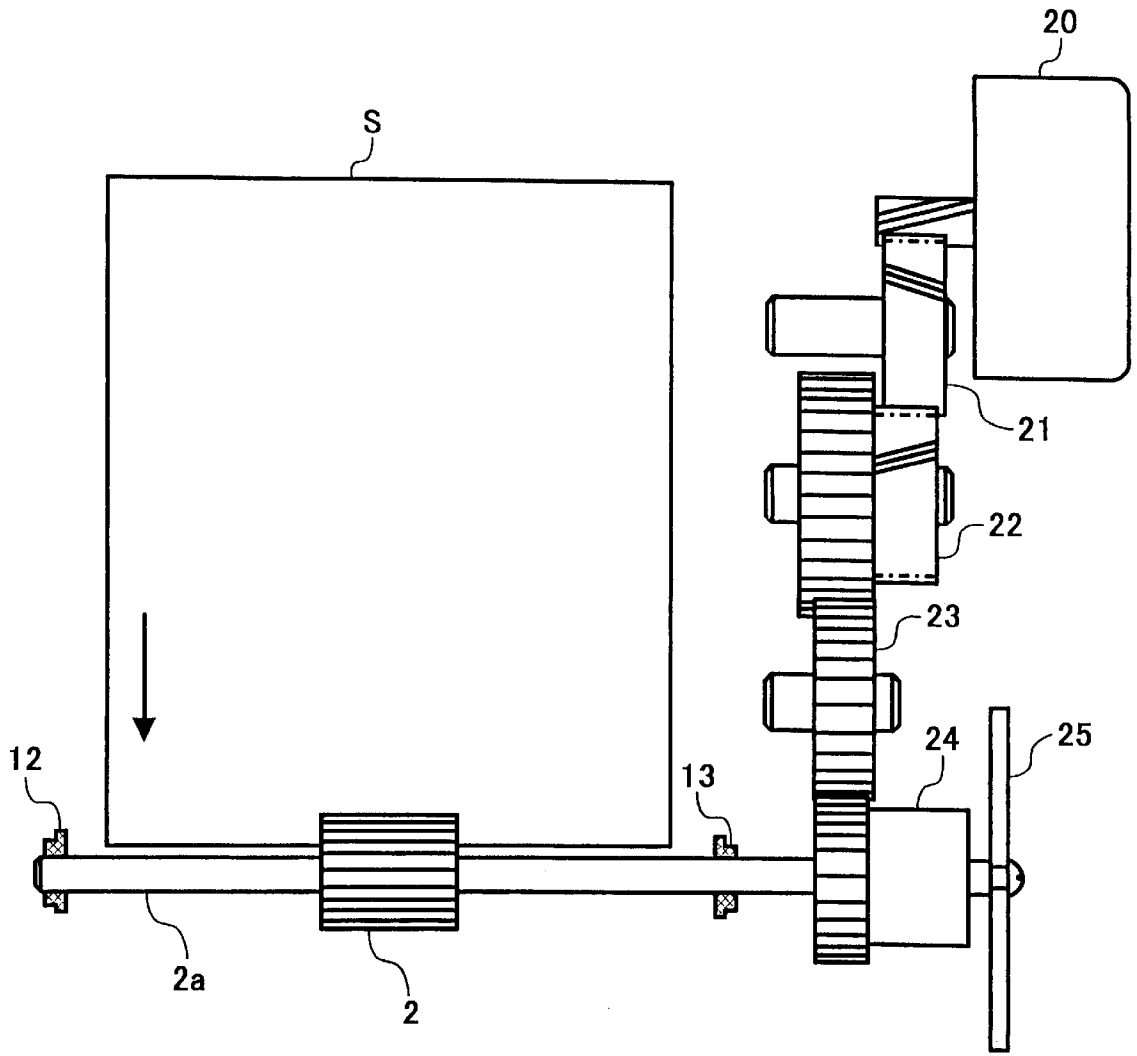
FIG. 5 is a schematic chart illustrating a configuration of a sheet feeding apparatus as one example according to the present invention.

FIG. 5 is a schematic chart illustrating one example of a sheet feeding apparatus configured such that the separation pad 3 does not contact or collide with the sheet-feeding roller 2. This example mechanically achieves the above-noted benefits. Specifically, a flywheel 25 is co-axially mounted on an axis 2*a* of the sheet-feeding roller 2 at its one end so that its inertia can continuously feed the uppermost sheet S of a next job into a nip formed between the separation pad 3 (not shown in FIG. 5) and sheet feeding roller 2 after the last sheet of a former job is fed.

Specifically, since the sheet feeding roller 2 is driven by a driving motor 20, its driving force is transmitted to a sheet feeding clutch 24 by a decelerating gear line including gears 21, 22, and 23, and is further transmitted to the shaft 2*a* of the sheet feeding roller 2 from the sheet feeding clutch 24. The shaft 2*a* of the sheet-feeding roller is supported by a pair of bearings 12 and 13 at its both ends and carries the sheet feeding roller 2 at its almost central position in a sheet feeding route.

The driving motor 20 and sheet feeding clutch 24 are driven, and motive energy is supplied and stopped from being supplied in accordance with an instruction from a control apparatus (not shown). However, as described above, even if a sheet S1 corresponding to the last copy of one job is fed, and the sheet feeding clutch 24 is disconnected when the trailing end S1e of the sheet S1 overlaps a sheet S2 corresponding to the uppermost sheet of the next job, only the tip S2h of the sheet S2 is pinched due to inertia.

Figure 6:
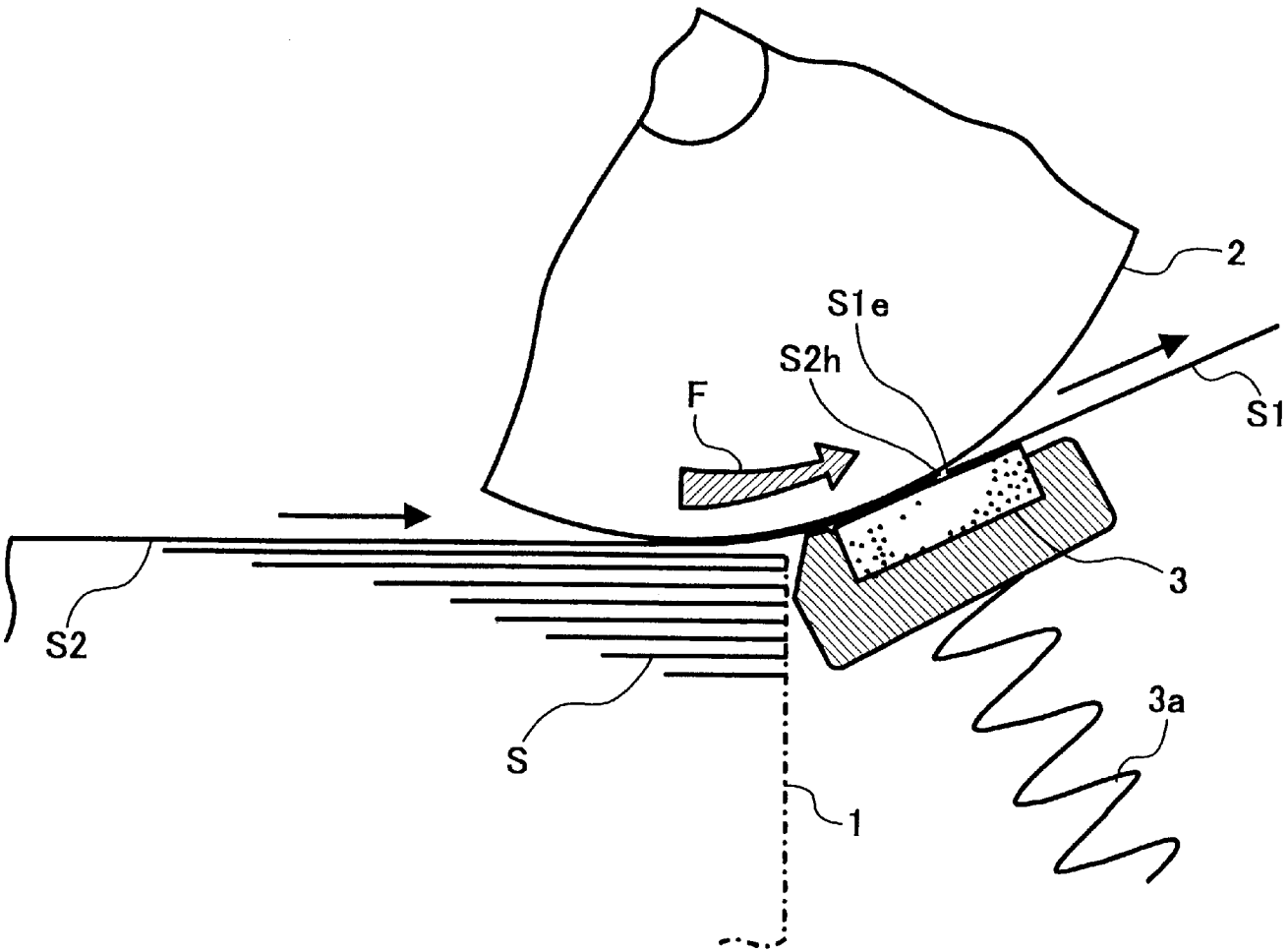
FIG. 6 is a chart illustrating a condition in which the last sheet of the former job is separated from the headmost sheet of the later job.
Figure 7:
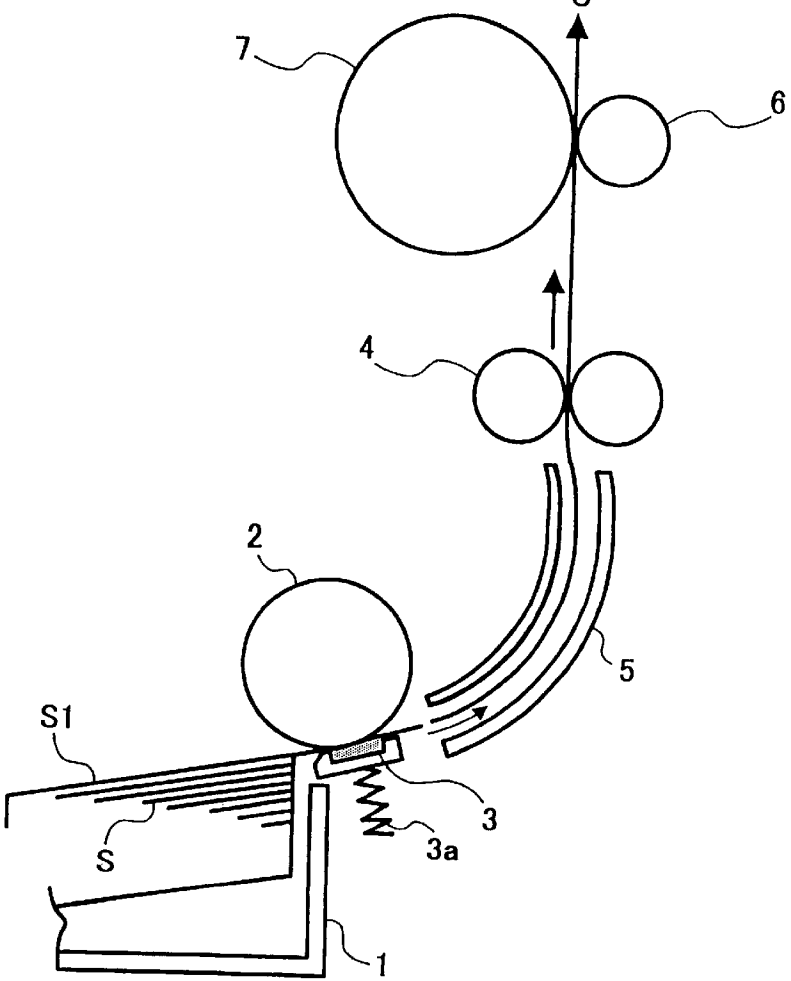
FIG. 7 BACKGROUND ART
FIG. 7 is a chart illustrating an exemplary background sheet feeding apparatus.
Figure 8:
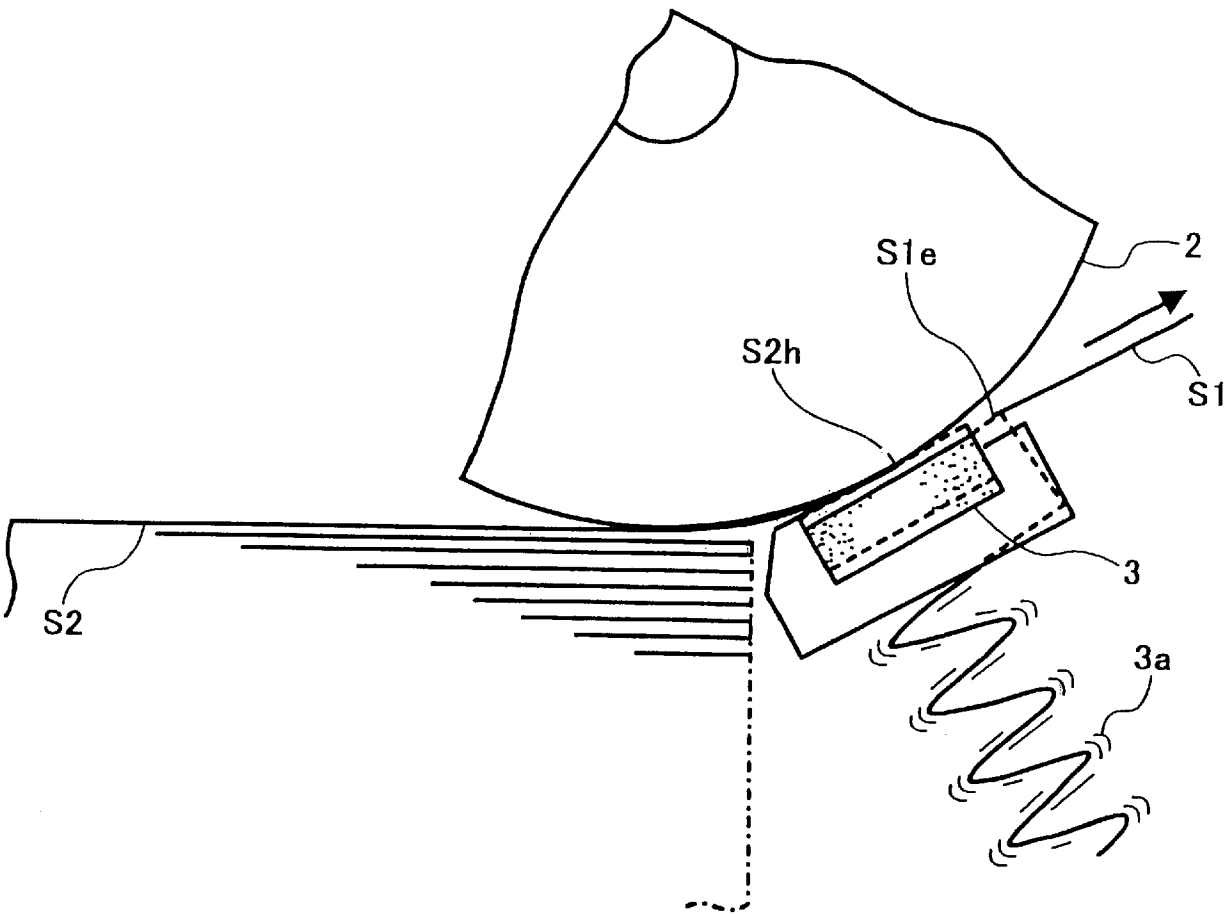
FIG. 8 BACKGROUND ART
FIG. 8 is a chart illustrating an operation of the background sheet feeding apparatus.

Specifically, since the flywheel is secured to the shaft 2*a* of the sheet feeding roller 2, the trailing end S1e of the sheet S1 eludes the nip as shown in FIG. 6 to a position as shown in FIG. 4 before the shaft 2*a* stops rotating due to the inertia of the flywheel 25, even if the driving force is stopped from traveling before the trailing end S1e of the sheet S1 arrives at the separation pad 3 section. Thus, an impact created when the trailing end S1e of the sheet S1 exits from the nip formed between the separation pad 3 and sheet feeding roller 2 is buffered by the pinched sheet S2.

Thus, this embodiment is configured such that the uppermost sheet S2 of the next job remains between the separation pad 3 and sheet feeding roller 2 by the inertia (inertia force F) created by the flywheel 25 during the time the sheet feeding clutch is deactivated and the sheet feeding roller 2 finally stops rotating. However, a control circuit (not shown) can provide a similar timing. Specifically, if a CPU 14 controlling a motor driving circuit 18 of a driving motor 20 (FIG. 9) deactivates the sheet feeding clutch at a timing when the trailing end of the last sheet S1 of the former job exits from the nip formed between the separation pad 3 and sheet feeding roller 2, and the uppermost sheet S2 of the next job remains therebetween, a similar operation can be performed by electric control.

Figure 9:
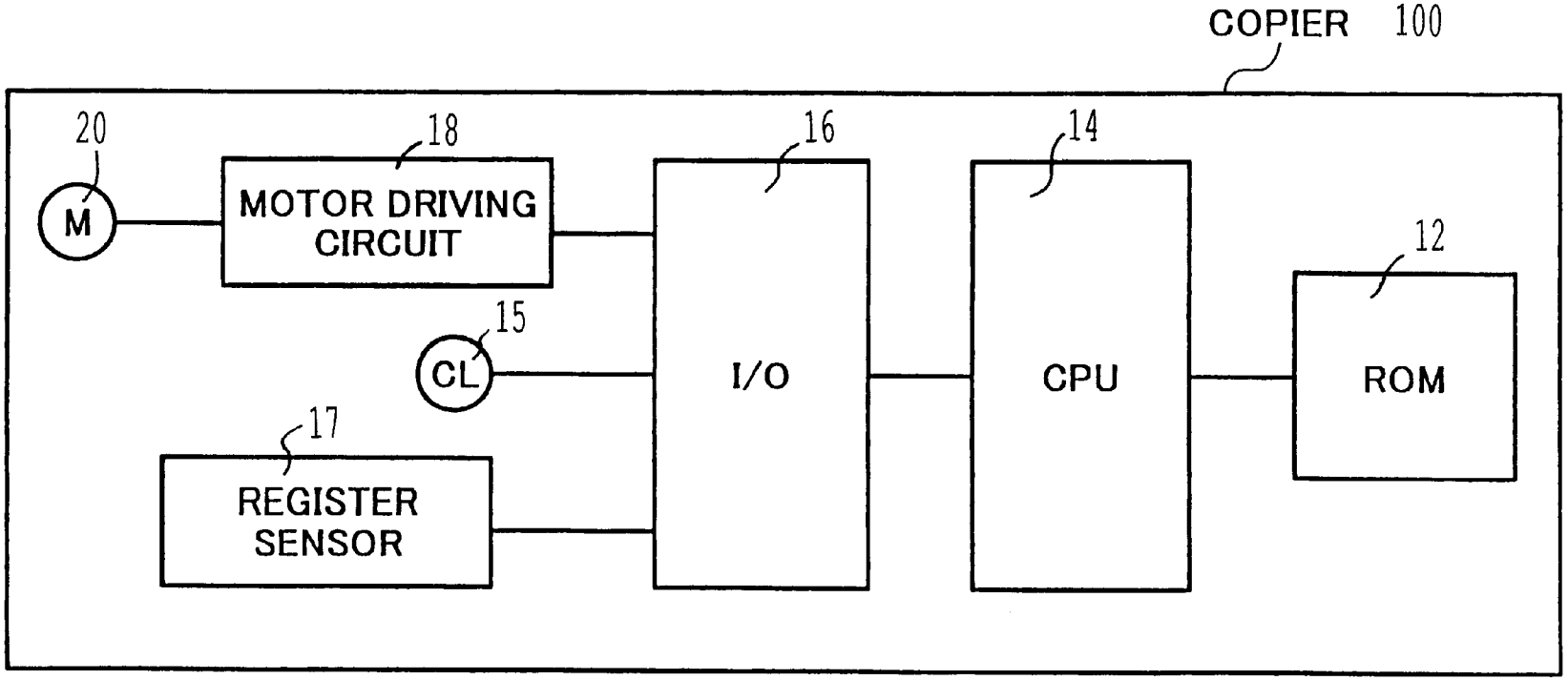
FIG. 9 is a diagram illustrating a control section in one embodiment according to the present invention.

The above-described several embodiments of the sheet-feeding apparatuses are controlled by a control section of FIG. 9. As shown in FIG. 9, CPU 14 that generally controls the entire operations of a copier 100, a ROM 12 that stores a control program, and an I/O 16 that performs input and output to and from the CPU 14 are included in a control section.

Specifically, the CPU 14 is connected to the ROM 12 and I/O 16. Further, the I/O 16 is connected to a register sensor 17, a motor driving circuit 18, and a sheet-feeding clutch 15. The motor driving circuit 18 is also connected to applicable motor driving sections 20 of the copier 100. Such a CPU 14 operates in accordance with a control program stored in the ROM 12 to take an input signal in from the register sensor 17 through the I/O 16, and to control the sheet-feeding clutch 15 to activate.

Figure 10:
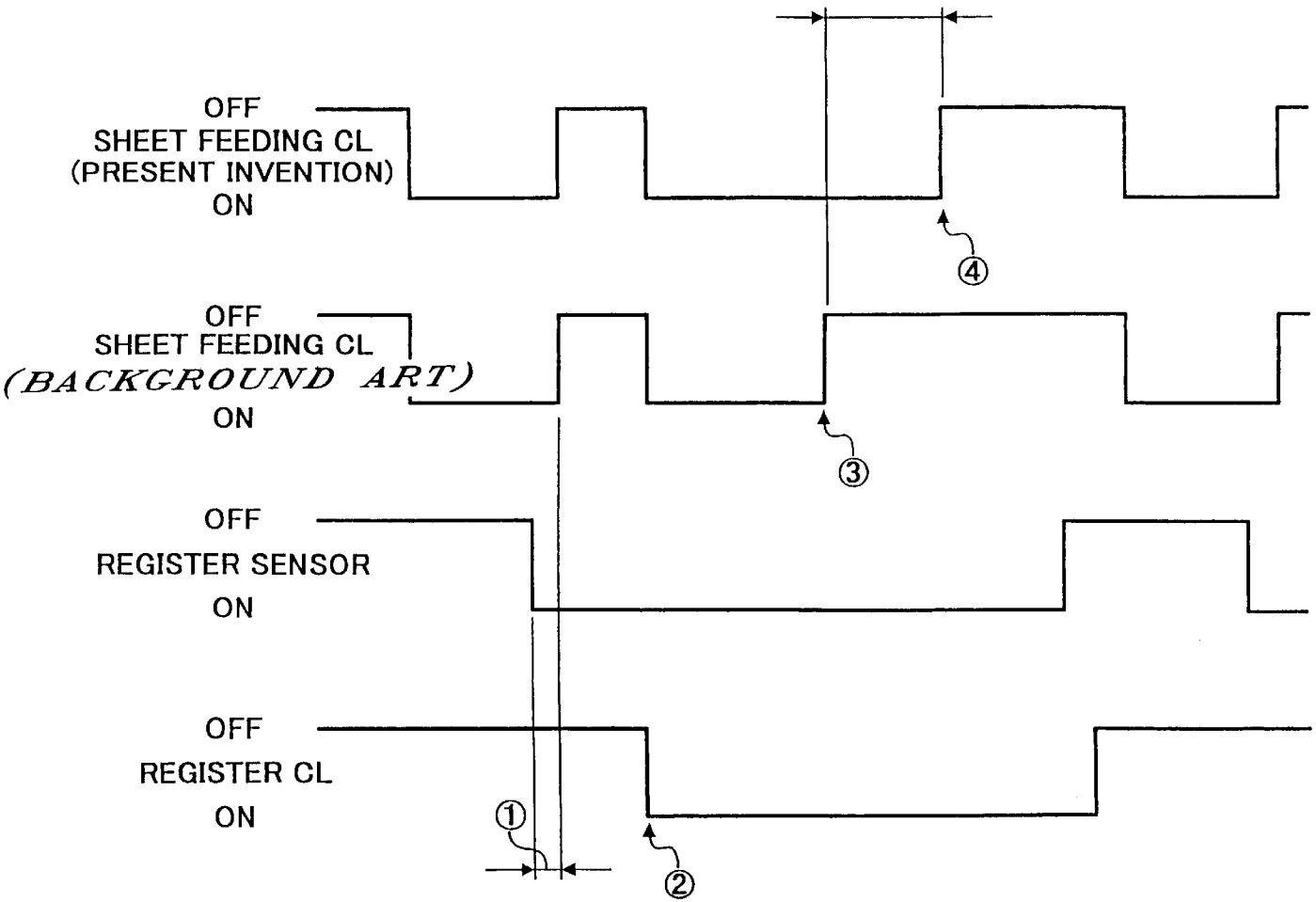
FIG. 10 is a timing chart illustrating a control operation in one embodiment according to the present invention.

As illustrated in FIG. 10, when the tip of the sheet contacts the register sensor 17, and thereby the register sensor 17 is activated, the sheet-feeding clutch 15 is turned ON until a prescribed amount of deflection of the sheet is created during an interval "$\hat{1}$".

Then, both the sheet-feeding clutch 15 and a register clutch (not shown) are activated again in synchronism with a writing unit in a timing "$\hat{2}$". As understood, a background sheet-feeding clutch is deactivated at a timing "$\hat{3}$" that is before the next sheet starts moving. In contrast, the present invention deactivates the sheet-feeding clutch at a prescribed timing "$\hat{4}$" later than that of "$\hat{3}$" such that an interval is substantially not created between the former and latter sheets.

According to this embodiment, by driving the sheet feeding roller 2 until the trailing end S1e of the last sheet S1 of the former job exits from the separation pad 3 and the tip S2h of the next sheet S2 is led in the separation pad substantially without an interval therebetween, vibration of the pressure spring 3*a* of the separate pad 3, which vibration is caused by bouncing of the compressed pressure spring 3*a* by the trailing end S1e of the sheet S1 slipping out therefrom, can be damped at that position. As a result, the compressed spring 3*a* does not comeback, and accordingly, the separation pad 3 does not directly contact the surface of the sheet feeding roller 2. As a result, vibration and percussive noises are suppressed.

Further, contact of the separation pad 3 to the feeding roller 2 and resonance of the pressure spring 3*a* to be caused between the former and later jobs can be suppressed by using the flywheel 25 even at conventional control timings. As a result, this type of vibration and percussive noises can be suppressed.

The mechanisms and processes set forth in the present invention may be implemented using one or more conventional general-purpose microprocessors and/or signal processors programmed according to the teachings in the present specification as will be appreciated by those skilled in the relevant arts. Appropriate software coding can readily be prepared by skilled programmers based on the teachings of the present disclosure, as will also be apparent to those skilled in the relevant arts. However, as will be readily apparent to those skilled in the art, the present invention also may be implemented by the preparation of application-specific integrated circuits by interconnecting an appropriate network of conventional component circuits or by a combination thereof with one or more conventional general purpose microprocessors and/or signal processors programmed accordingly. The present invention thus also includes a computer-based product which may be hosted on a storage medium and include, but is not limited to, any type of disk including floppy disks, optical disks, CD-ROMs, magnet-optical disks, ROMs, RAMs, EPROMs, EEPROMs, flash memory, magnetic or optical cards, or any type of media suitable for storing electronic instructions.

Numerous additional modifications and variations of the present invention are possible in light of the above teachings. It is therefore to be understood that within the scope of the appended claims, the present invention may be practiced otherwise than as specifically described herein.

What is claimed is:

1. A sheet feeding method, comprising:

starting a first job;

launching sheets from a sheet containing tray by driving a sheet feeding roller for a prescribed time period;

separating a first of the sheets using a separation pad;

feeding the first separated sheet toward a prescribed position by the sheet feeding roller;

repeating the launching, separating, and feeding of sheets;

terminating the first job; and causing an uppermost sheet of a second job, subsequent to the first job, to enter into a nip formed between the sheet feeding roller and separation pad substantially before a surface of the sheet feeding roller contacts a surface of the separation pad.

2. The sheet feeding method according to claim 1, wherein said causing the uppermost sheet to enter into the nip is performed by driving the sheet feeding roller for a time longer than a time for previous driving for the first sheet.

3. The sheet feeding method according to claim 1, wherein said causing the uppermost sheet to enter into the nip is performed by inertia generated by the sheet feeding roller when the first job is completed.

4. A sheet feeding apparatus, comprising:

a sheet containing tray configured to stack sheets;

a sheet feeding roller operative to launch sheets from the stack of sheets; and a separation pad operative to separate the launched sheets;

wherein, the sheet feeding roller stops rotating while pinching an uppermost sheet of a next job in cooperation with the separation pad substantially before a surface of the sheet feeding roller contacts a surface of the separation pad.

5. The sheet feeding apparatus according to claim 4, further comprising an inertia generating device configured to generate an inertia force, said inertia generating device connected to the sheet feeding roller, wherein said inertia forwards the uppermost sheet of the next job to a nip formed between the sheet feeding roller and sheet separation pad substantially before the surface of the sheet feeding roller contacts the surface of the separation pad.

6. The sheet feeding apparatus according to claim 5, wherein said inertia generating device includes a flywheel.

7. The sheet feeding apparatus according to claim 4, further comprising a sheet feeding roller control device configured to control the sheet feeding roller to rotate at a prescribed timing for a prescribed time period, wherein said sheet feeding roller control device drives the sheet feeding roller for a time longer than a time when a last sheet of a precedent job is launched to cause the uppermost sheet to enter into a nip formed between the sheet feeding roller and sheet separation pad.

8. An image forming apparatus including a sheet feeding apparatus, said sheet feeding apparatus comprising:

a sheet containing tray configured to stack sheets;

a sheet feeding roller operative to launch from the stack of sheets; and a separation pad operative to separate the launched sheets;

wherein, the sheet feeding roller stops rotating while pinching an uppermost sheet of a next job in cooperation with the separation pad substantially before a surface of the sheet feeding roller contacts a surface of the separation pad.

9. The image forming apparatus according to claim 8, further comprising an inertia generating device configured to generate inertia force, said inertia generating device connected to the sheet feeding roller, wherein said inertia forwards the uppermost sheet of the next job to a nip formed between the sheet feeding roller and sheet separation pad substantially before the surface of the sheet feeding roller contacts the surface of the separation pad.

10. The image forming apparatus according to claim 9, wherein said inertia generating device includes a flywheel.

11. The image forming apparatus according to claim 9, further comprising a sheet feeding roller control device configured to control the sheet feeding roller to rotate at a prescribed timing for a prescribed time period, wherein said sheet feeding roller control device drives the sheet feeding roller for a time longer than a time when a last sheet of a precedent job is launched to cause the uppermost sheet to enter into a nip formed between the sheet feeding roller and sheet separation pad.

12. A sheet feeding apparatus, comprising:

means for stacking sheets;

means for launching sheets from the stack of sheets; and means for separating the launched sheets;

wherein, the means for launching the sheets stops rotating while pinching an uppermost sheet of a next job in cooperation with the separating means substantially before a surface of the sheet launching means contacts a surface of the separating means.

13. The sheet feeding apparatus according to claim 12, further comprising means for generating an inertia force, said inertia generating means connected to the sheet launching means, wherein said inertia forwards an uppermost sheet into a nip formed between the sheet launching means and the sheet separating means when a precedent job is completed.

14. A sheet feeding method, comprising:

starting a first job;

launching sheets from a sheet containing tray by driving a sheet feeding roller for a prescribed time period;

separating a first of the sheets using a separation pad;

feeding a first separated sheet toward a prescribed position by the sheet feeding roller;

repeating the launching, separating, and feeding of sheets;

terminating the first job; and causing an uppermost sheet of a second job, subsequent to the first job, to enter into a nip formed between the sheet feeding roller and separation pad before a last sheet of the first job leaves the nip.

15. The sheet feeding method according to claim 14, wherein said causing the uppermost sheet to enter into the nip is performed by inertia generated by the sheet feeding roller when the first job is completed.

16. The sheet feeding method according to claim 14, wherein said causing the uppermost sheet to enter into the nip is performed by inertia generated by the sheet feeding roller when the first job is completed.

* * * * *